US008464949B2

(12) United States Patent
Namey et al.

(10) Patent No.: US 8,464,949 B2
(45) Date of Patent: Jun. 18, 2013

(54) METHOD AND SYSTEM FOR COUNTERING AN INCOMING THREAT

(75) Inventors: Mark A. Namey, McKinney, TX (US); James F. Kviatkofsky, Allen, TX (US); James R. Toplicar, Plano, TX (US)

(73) Assignee: Raytheon Company, Waltham, MA (US)

( * ) Notice: Subject to any disclaimer, the term of this patent is extended or adjusted under 35 U.S.C. 154(b) by 258 days.

(21) Appl. No.: 13/034,545

(22) Filed: Feb. 24, 2011

(65) Prior Publication Data

US 2012/0217301 A1 Aug. 30, 2012

(51) Int. Cl.

| | |
|---|---|
| ***G06F 19/00*** | (2011.01) |
| ***G06G 7/80*** | (2006.01) |
| ***G01S 7/36*** | (2006.01) |
| ***G01S 13/08*** | (2006.01) |
| ***F41G 7/00*** | (2006.01) |

(52) U.S. Cl.
USPC ..... 235/411; 244/3.1; 342/13; 342/14; 342/52; 342/61; 342/62; 235/404; 235/412; 235/413

(58) Field of Classification Search
USPC ..... 235/411; 342/13–14, 52, 61–62, 342/67; 244/3.1
See application file for complete search history.

(56) References Cited

U.S. PATENT DOCUMENTS

| | | | | |
|---|---|---|---|---|
| 4,682,528 | A | 7/1987 | Wohler | |
| 4,700,609 | A * | 10/1987 | Wiethoff et al. | 89/46 |
| 6,903,676 | B1 | 6/2005 | Frady et al. | |
| 6,920,827 | B2 | 7/2005 | Lloyd | |
| 7,077,049 | B2 | 7/2006 | Shumov et al. | |
| 7,104,496 | B2 | 9/2006 | Chang | |
| 7,202,809 | B1 | 4/2007 | Schade et al. | |
| 7,477,469 | B2 | 1/2009 | Cook et al. | |
| 7,492,308 | B2 | 2/2009 | Benayahu et al. | |
| 2007/0244673 | A1 * | 10/2007 | Khosla et al. | 703/2 |
| 2010/0026554 | A1 * | 2/2010 | Longman et al. | 342/62 |
| 2011/0127328 | A1 * | 6/2011 | Warren | 235/412 |

* cited by examiner

*Primary Examiner* — Michael G Lee
*Assistant Examiner* — Laura Gudorf
(74) *Attorney, Agent, or Firm* — Daly, Crowley, Mofford & Durkee, LLP

(57) ABSTRACT

A method including detecting a threat incoming to a vehicle, the vehicle having a plurality of countermeasures including a primary armament and an active protection system, communicating the detected threat to a controller, activating, with the controller, a first sensor in response to the detecting, the first sensor tracking the incoming threat and generating tracking data, routing, with the controller, the tracking data to a plurality of fire control processors, each of the plurality of fire control processors being associated with a respective one of the plurality of countermeasures, and the plurality of fire control processors simultaneously computing respective firing solutions using the tracking data, and determining, with the controller, a preferred countermeasure out of the plurality of countermeasures with which to counter the incoming threat.

19 Claims, 4 Drawing Sheets

METHOD AND SYSTEM FOR COUNTERING AN INCOMING THREAT

BACKGROUND

Combat vehicles such as tanks and personnel carriers are indispensible tools in times of war. Generally, such combat vehicles are protected from enemy fire by some type of armor. However, as enemy weapon systems have advanced, passive protection systems, such as armor, have become less effective. As a result, active protection systems have been developed that attempt to defeat threats such as anti-tank guided missiles and rocket propelled grenades before they reach the combat vehicle. Specifically, an active protection system may, upon detection of an incoming threat, launch an interceptor missile to destroy the incoming threat. But active protection systems may be costly to implement and maintain, for instance, because interceptor missiles are expensive compared to traditional rounds. Further, a combat vehicle outfitted with an active protection system may be limited in the number of interceptor missiles it may have onboard at any one time. Vehicle protection systems that are cost effective and extend mission lifecycles are needed.

BRIEF DESCRIPTION OF THE DRAWINGS

A better understanding of the present invention will be realized from the detailed description that follows, taken in conjunction with the accompanying drawings, in which.

DETAILED DESCRIPTION

The following disclosure provides many different embodiments, or examples, for implementing different features of the invention. Specific examples of components and arrangements are described below to simplify the present disclosure. These are, of course, merely examples and are not intended to be limiting.

Figure 1:
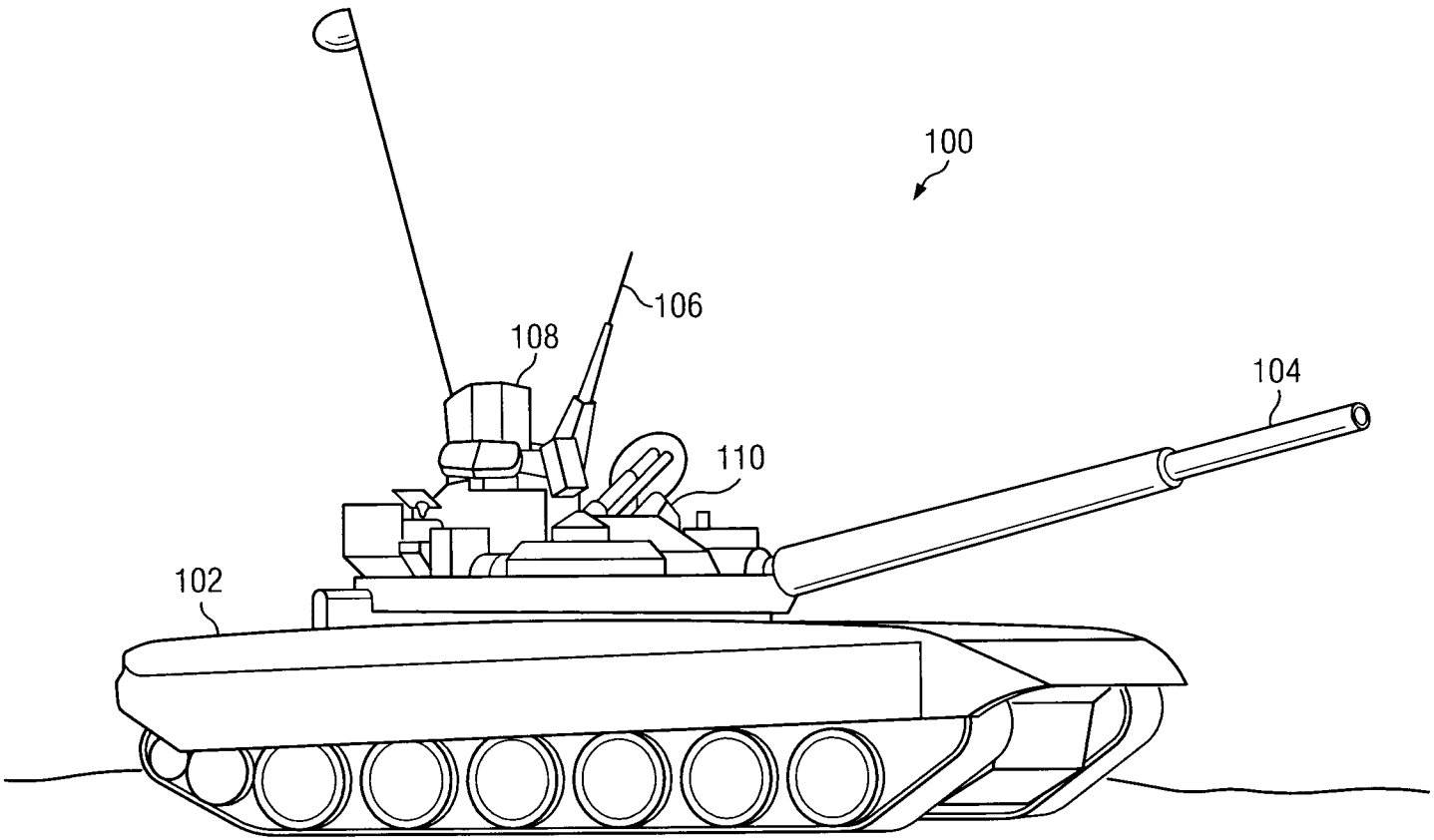
FIG. 1 is an illustration of a hit avoidance system deployed on a combat vehicle.

FIG. 1 is an illustration of a hit avoidance system 100 deployed on a combat vehicle 102. Hit avoidance system 100 detects, tracks, and attempts to detect incoming threats to combat vehicle 102. Incoming threats may include anti-tank guided missiles (ATGM), rocket-propelled grenades (RPG), kinetic energy projectiles, or other projectiles capable of damaging a combat vehicle. In general, the hit avoidance system 100 protects combat vehicle 102 by utilizing not only an active protection system but also the vehicle's primary and secondary armaments. In this manner, incoming threats may be defeated by either munitions fired from a turret-based armament or interceptors fired from an active protection system. Not only does system 100 provide an extra layer of protection for combat vehicle 102, but it does so in a manner that is cost effective and increases the vehicle's mission lifecycle. Using cost efficient turret rounds to defeat incoming threats saves expensive interceptor missiles and also prolongs the time the vehicle can operate in the field before it must return to base and rearm. The hit avoidance system 100 will be discussed in greater detail in association with FIG. 2. In the current embodiment, combat vehicle 102 is a tank, however, in alternative embodiments the combat vehicle may be an armed personnel carrier, amphibious assault vehicle, seagoing gunship, or some other combat vehicle with at least a primary armament, such as a turret gun. Combat vehicle 102 includes primary armament 104. In the current embodiment, primary armament 104 is a Mk44 Bushmaster II 30 mm chain gun manufactured by Alliant Techsystems of Minneapolis, Minn. Primary armament 104 is loaded with 30 mm or 40 mm airburst rounds that are designed to detonate in midair and disburse shrapnel in a concentrated area. In alternative embodiments, primary armament 104 may be any other weapon that fires airburst-type rounds or other rounds that, upon detonation, disrupt an area larger than the round itself. Combat vehicle 102 further includes a secondary armament 106. In the current embodiment, secondary armament 106 is a XM153 Common Remotely Operated Weapons Station (CROWS) mounted with a MK47 Grenade Launcher. Secondary armament 106 may also be loaded with airburst rounds or airburst-type rounds. Alternatively, combat vehicle 102 may not include a secondary armament 106 or the secondary armament may be some other type of vehicle-based weapon capable of firing airburst-type rounds.

Combat vehicle 102 also includes a sensor system or sensor suite 108. In the current embodiment, sensor suite 108 may include one or more sensors including radar-based sensors, electro-optical/infrared (EO/IR)-based sensors, laser-based sensors, and other sensors capable of detecting and/or tracking incoming threats to combat vehicle 102. Additionally, combat vehicle 102 includes an active protection system (APS) 110. If an incoming threat is detected by one or more of the sensors in sensor suite 108, APS 110 is capable of almost instantaneously deploying a hard kill countermeasure to destroy the threat. In the current embodiment, the APS 110 is a Quick Kill System from Raytheon Company of Waltham, Mass., but, in alternative embodiments, APS 110 may be another type of active protection system.

Figure 2:
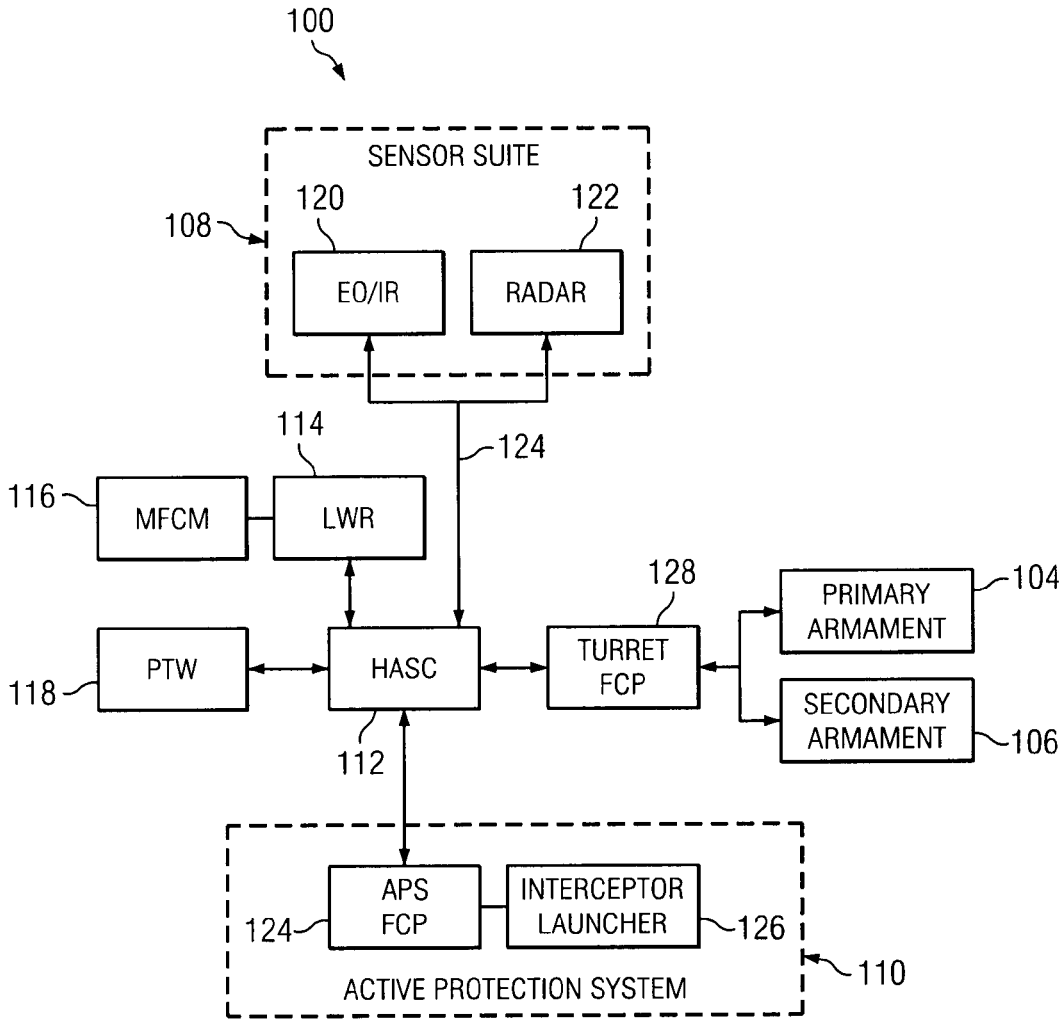
FIG. 2 is a functional block diagram of an exemplary embodiment of the hit avoidance system of FIG. 1.

FIG. 2 is a functional block diagram of an exemplary embodiment of the hit avoidance system 100 of FIG. 1. As previously discussed, the hit avoidance system 100 attempts to defeat incoming threats to combat vehicle 102. To do so, hit avoidance system 100 incorporates features customarily found on a combat vehicle such as the sensing devices, armaments, and active protection systems. As such, in the current embodiment, hit avoidance system 100 includes sensor suite 108, primary and secondary armaments 104 and 106, and active protection system 110.

In more detail, hit avoidance system 100 includes a hit avoidance system controller (HASC) 112. HASC 112 electronically controls the operation of the hit avoidance system 100. Generally, HASC 112 is a hardware and software solution operable to process input from the sensing devices on combat vehicle 102, compute a hit avoidance solution, and initiate hit avoidance action based on the solution. In one embodiment, HASC 112 is a custom computer system with at least a processor and an associated memory that is installed in combat vehicle 102. The memory may store software that is executable by the processor to control the HASC 112. In alternative embodiments, however, HASC 112 may be a remote computer system that communicates with the hit avoidance system 100 in combat vehicle 102 over a communication network.

Hit avoidance system 100 includes both soft kill and hard kill countermeasures. Soft kill countermeasures generally are designed to confuse the targeting mechanism of an incoming threat, thereby reducing the chance of a direct hit. Hard kill countermeasures, such as deployed by APS 110, are designed to physically counteract an incoming threat by destroying it or physically altering its intended path. In the current embodiment, the soft kill capabilities of hit avoidance system 100 are implemented with a laser warning receiver (LWR) 114 and a multifunction countermeasure (MFCM) 116, both of which are coupled to the HASC 112. The LWR 114 is operable to detect laser emissions from laser beam rider missile systems impinging on the combat vehicle 102. The MFCM 116 is operable to deploy soft kill countermeasures in response to the detection of impinging lasers by the LWR 114. Further, hit avoidance system 100 includes a passive threat warner (PTW) 118 coupled to the HASC 112. PTW 118 is operable to detect muzzle flash indicative of the launch of an incoming projectile.

The sensor suite 108 on combat vehicle 102 is incorporated into the hit avoidance system 100. In the current embodiment, the sensor suite 108 includes an electro-optical/infrared (EO/IR) sensor 120 and a radar 122. The EO/IR sensor 120 and radar 122 are coupled to HASC 112 via a sensor suite control (SSC) bus 124. In more detail, EO/IR sensor 120 is a electro-optical and infrared full-motion video camera system that provides long-range surveillance, acquisition, and tracking. Further, in the current embodiment, the radar 122 is an Active Electronically Scanned Array (AESA) radar system. The sensor suite 108 may alternatively include additional or different sensor systems known in the art.

The hit avoidance system 100 additionally incorporates the active protection system (APS) 110. The APS 110 includes a fire control processor (FCP) 124 coupled to the HASC 112. The APS FCP 124 is operable to calculate firing solutions for the APS 110 based on tracking data from sensor suite 108, including radar 122. APS 110 further includes an interceptor launcher 126 coupled to the APS FCP 124. In one embodiment, interceptor launcher 126 is armed with two types of interceptor missiles to defeat incoming projectiles: a smaller type designed to intercept close-in threats such as RPGs and a larger type designed to intercept fast moving anti-tank missiles and tank rounds. The APS FCP 124 provides firing solutions to interceptor launcher 126 and initiates launches of interceptor missiles. In one embodiment, the interceptor launcher 126 is positioned to launch interceptor missiles vertically as to provide 360 degrees of protection. Also, in some embodiments the radar 122 may be considered part of the APS 110 and thus may be coupled directly to the APS FCP 124.

The primary armament 104 and the secondary armament 106 of combat vehicle 102 are also integrated into the hit avoidance system 100. In the current embodiment, rounds fired from primary armament 104 and secondary armament 106 are used as hard kill countermeasures as well as offensive munitions. Primary armament 104 and the secondary armament 106 are coupled to HASC 112 via a turret FCP 128. Turret FCP 128 is operable to calculate firing solutions for the armaments 104 and 106 and initiate firings. As mentioned above, in the current embodiment, the primary and secondary armaments 104 and 106 are loaded with airburst rounds, which are typically less expensive than the interceptor missiles launched by the APS 110. Further, a vehicle with both a turret-based primary armament and an active protection system, such as combat vehicle 102, typically carries more turret rounds than APS interceptor missiles.

In operation, hit avoidance system 100 protects combat vehicle 102 from incoming threats by utilizing not only the active protection system 110, but also the combat vehicle's primary and secondary armaments 104 and 106. Generally, if soft kill countermeasures fail to deter an incoming projectile, the hit avoidance system 100 will determine which hard kill countermeasure—primary armament 104, the secondary armament 106, or APS 110—is preferred to counter the threat. Rather than automatically initiating the launch of an APS interceptor missile upon detection of a threat, the hit avoidance system 100 analyzes tracking data from sensor suite 108 and applies one or more algorithms to determine which of the countermeasures most suited to defeat the threat. The inclusion of the primary and secondary armaments in the hit avoidance system's kill chain bolsters the combat vehicle's defenses by giving it additional countermeasures that are economical but highly accurate.

In more detail, hit avoidance system 100 will detect an incoming threat with the passive threat warner (PTW) which 118 scans for muzzle flash—an indication that a projectile has launched. If the PTW 118 detects muzzle flash, threat tracking is handed off to hit avoidance system 100, so hard kill countermeasures may be initialized.

Figure 3:
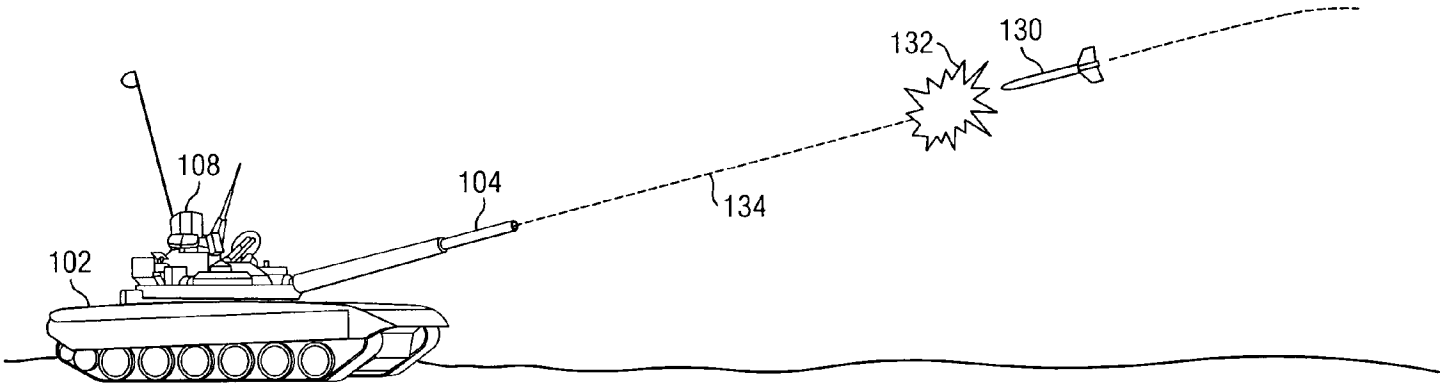
FIG. 3 is an illustration depicting the combat vehicle and hit avoidance system of FIG. 1 countering an incoming projectile with a primary armament of the combat vehicle.
Figure 4:
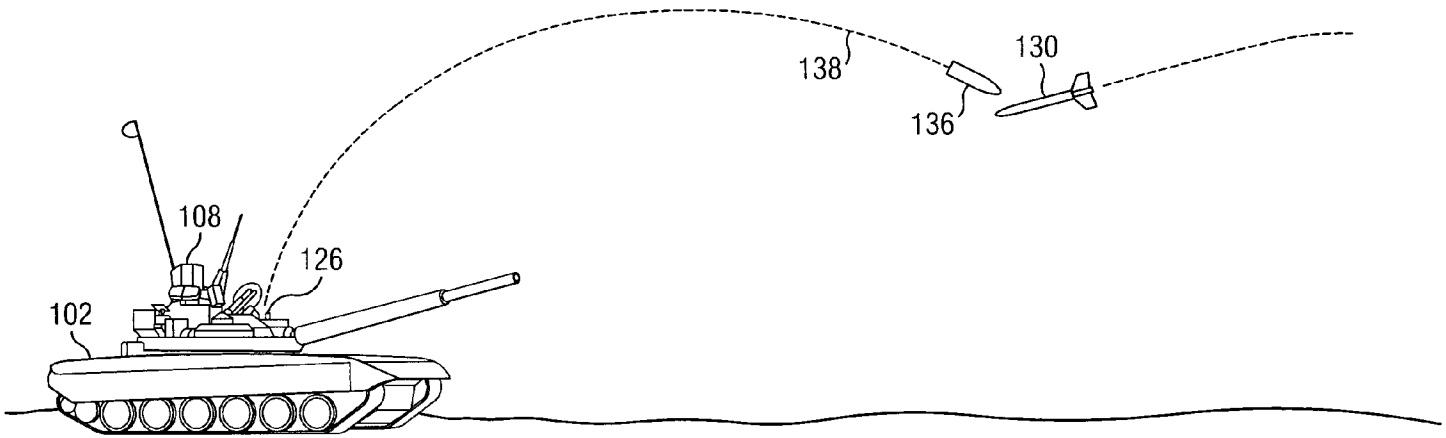
FIG. 4 is an illustration depicting the combat vehicle and hit avoidance system of FIG. 1 countering an incoming projectile with an active protection system of the combat vehicle.

Once threat tracking is passed to hit avoidance system 100, the radar 122 begins tracking the incoming projectile. In the current embodiment, as radar 122 tracks the incoming projectile, it calculates attitude, position, and range data and feeds it to the APS FCP 124 in real-time. Likewise, the EO/IR sensor 120 will track the incoming projectile, providing position data to the turret FCP 128 in real-time. In alternative embodiments, EO/IR sensor 120 and radar 122 may each transmit position data to both the APS FCP 124 and turret FCP 128. In addition to feeding attitude, range, and position data to FCPs 124 and 128, the radar 122 will transmit the data to the hit avoidance system controller (HASC) 112. As APS FCP 124 and turret FCP 128 receive tracking data, they simultaneously calculate firing solutions for their respective munitions. While EO/IR sensor 120 and radar 122 are tracking the incoming projectile and FCPs 124 and 128 are calculating respective firing solutions, HASC 112 analyzes the tracking data and applies one or more algorithms to determine which hard kill countermeasure to utilize first. HASC 112 may take into account at least the following factors when making the determination as to which countermeasure to fire first: (1) distance of incoming projectile from combat vehicle 102, (2) effectiveness of each countermeasure against threat type, (3) effect of residual shrapnel on combat vehicle 102 and surrounding area, (4) number of rounds for each countermeasure available onboard combat vehicle 102. This list is not exhaustive and the decision algorithm of HASC 112 may take into account additional or different factors. FIGS. 3 and 4 depict two possible threat defeat scenarios resulting from the HASC's determination.

FIG. 3 is an illustration depicting the combat vehicle 102 and hit avoidance system 100 of FIG. 1 defeating an incoming projectile 130 with primary armament 104. In the scenario depicted by FIG. 3, HASC 112 has determined that a round fired by primary armament 104 is most suited to counter the incoming projectile 130 based on tracking data provided by sensor suite 108. HASC 112 sends a command via SSC 124 to the turret FCP 128 to initiate the firing of a round with the primary armament 104. Subsequently, the turret FCP 128 sends a "slew-to-cue" command to the primary armament 104 such that the main turret slews around to a firing position based on the most current firing solution. In the current embodiment, primary armament fires multiple airburst rounds 132. The airburst rounds 132 travel along trajectory 134 and detonate immediately prior to reaching projectile 130. The detonations explode the airburst rounds, creating a concentrated cloud of shrapnel in the path of the projectile 130. Ideally, the airburst shrapnel destroys the projectile 130 but it may alternatively displace it from its intended trajectory by an amount great enough to prevent a direct hit on combat vehicle 102. In one embodiment, primary armament 104 may be preferred for countering incoming projectiles at long range (e.g. over 500 meters) because (1) the main turret of primary armament 104 must slew around prior to firing and (2) the risk of harm to the combat vehicle 102 or nearby dismounted soldiers from airburst shrapnel is reduced when the threat is engaged at long range. Additionally, the scenario illustrated by FIG. 3 may be similar to the scenario in which the HASC 112 determines that the secondary armament 106 on combat vehicle 102 is most suitable to counter the incoming projectile 130.

FIG. 4 is an illustration depicting the combat vehicle 102 and hit avoidance system 100 of FIG. 1 countering the incoming projectile 130 with active protection system 110. In the scenario depicted by FIG. 4, HASC 112 has determined that a long range interceptor missile 136 fired by the APS 110 is most suited to counter the incoming projectile 130 based on tracking data calculated by sensor suite 108. Once that decision has been made, HASC 112 sends a command to the APS FCP 124 to initiating the firing of interceptor missile 136 from interceptor launcher 126. In the current embodiment, the interceptor launcher 126 launches vertically from the interceptor missile 136 using pressurized gas—a technique known as soft launching. Once the interceptor missile 136 is away from the combat vehicle, thrusters position it such that it points in the direction of the incoming projectile 130. Once aligned, a rocket motor is ignited and the interceptor missile 136 is accelerated along trajectory 138 towards projectile 130. In one embodiment, the interceptor missile 136 contains a focused blast warhead that detonates when in close vicinity to the incoming projectile 130.

Figure 5:
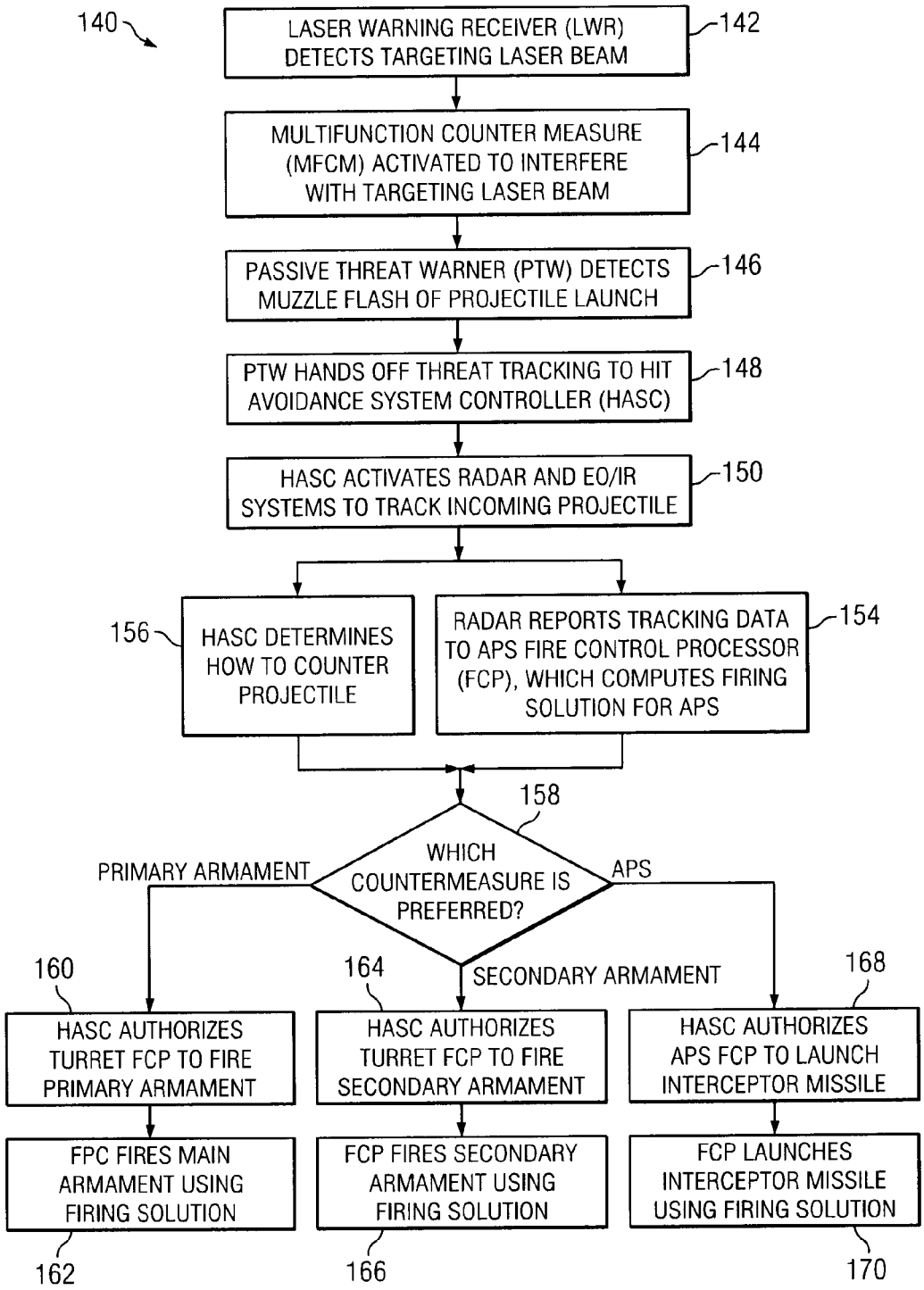
FIG. 5 is a high-level flowchart illustrating a method of countering an incoming threat using the hit avoidance system of FIG. 1.

FIG. 5 is a high-level flowchart illustrating a method 140 of countering an incoming threat using the hit avoidance system 100 of FIG. 1. Method 140 begins at block 142 where the laser warning receiver (LWR) 114 detects a targeting laser beam impinging on the combat vehicle 102. Then, at block 144, the multifunction countermeasure (MFCM) 116 is activated to jam or decoy the targeting system. At block 146, the passive threat warner (PTW) 118 detects muzzle flash of a projectile launch. Next, method 140 continues to block 148 where the PTW 118 hands off tracking of the incoming projectile to the hit avoidance system controller (HASC) 112. Then, at block 150, the HASC 112 activates the radar 122 to track the incoming projectile. Next, method 140 simultaneously branches to blocks 154 and 156. In block 154, the radar 122 calculates the attitude, position, and range of the incoming projectile and reports this tracking data to the APS FCP 124, which begins calculating a firing solution. Alternatively, the radar 122 may also report tracking data to the turret FCP 128. Meanwhile, in block 156, HASC 112 begins calculating which countermeasure would be preferred in countering the incoming threat based in part on tracking data from radar 122. Next, at block 158, it is determined which countermeasure—primary armament 104, secondary armament 106, or APS 110—would be preferred in countering the incoming threat. If HASC 112 determines that the primary armament 104 is most suited, method 112 proceeds to block 160 where HASC 112 authorizes the turret FCP 128 to fire primary armament 104. From block 160, method 140 concludes to block 162 where turret FCP 128 fires the primary armament 104 at the incoming projectile using the most current firing solution. If, instead, HASC 112 determines that the secondary armament 106 is most suited to counter the incoming projectile, method 112 proceeds to block 164 where HASC 112 authorizes the turret FCP 128 to fire secondary armament 106. From block 164, method 140 concludes at block 166 where turret FCP 128 fires the secondary armament 106 at the incoming projectile using the most current firing solution. Finally, if HASC 112 determines that the APS 110 is most suited to counter the incoming projectile, method 112 proceeds to block 168 where HASC 112 authorizes the APS FCP 128 to launch an interceptor missile 136. From block 168, method 140 concludes at block 170 where APS FCP 128 launches the interceptor missile 136 from interceptor launcher 126 using the current firing solution.

The foregoing outlines features of selected embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure, as defined by the claims that follow.

What is claimed is:

1. A method, comprising:

detecting a threat incoming to a vehicle, the vehicle having a plurality of countermeasures including a primary armament and an active protection system; communicating the detected threat to a controller;

activating, with the controller, a first sensor in response to the detecting, the first sensor tracking the incoming threat and generating tracking data;

routing, with the controller, the tracking data to a plurality of fire control processors, each of the plurality of fire control processors being associated with a respective one of the plurality of countermeasures and being configured to compute respective firing solutions using the tracking data; and determining, with the controller, a preferred countermeasure out of the plurality of countermeasures with which to counter the incoming threat.

2. The method of claim 1, wherein the plurality of countermeasures includes a secondary armament.

3. The method of claim 1, wherein the primary armament is a turret-based armament configured to fire explosive rounds containing shrapnel.

4. The method of claim 1, wherein the determining the preferred countermeasure is based at least in part on the tracking data.

5. The method of claim 1, further comprising:

authorizing firing of the preferred countermeasure using the firing solution associated with the preferred countermeasure.

6. The method of claim 1, wherein the active protection system includes an interceptor launcher configured to launch explosive interceptors.

7. The method of claim 1, further comprising: activating a second sensor in response to the detecting, the second sensor tracking the incoming threat and generating further tracking data; wherein the routing the tracking data includes routing the further tracking data.

8. A threat countering system, the system comprising:

a first sensor configured to detect an incoming threat and generate tracking data associated with the incoming threat;

a plurality of countermeasures including a primary armament and an active protection system;

a plurality of fire control processors, each of the plurality of fire control processors being associated with a respective one of the plurality of countermeasures and being configured to compute respective firing solutions using the tracking data; and a controller coupled to the first sensor and the plurality of fire control processors, the controller configured to receive the detected incoming threat and determine a preferred countermeasure out of the plurality of countermeasures with which to counter the incoming threat.

9. The threat countering system of claim 8, wherein the plurality of countermeasures includes a secondary armament.

10. The threat countering system of claim 8, wherein the primary armament is a turret-based armament configured to fire explosive rounds containing shrapnel.

11. The threat countering system of claim 8, wherein the controller is further operable to determine the preferred countermeasure based at least in part on the tracking data.

12. The threat countering system of claim 8, wherein the controller is further operable to authorize firing the preferred countermeasure.

13. The threat countering system of claim 8, wherein the active protection system includes an interceptor launcher configured to launch explosive interceptors.

14. A threat countering system, the system comprising:

a first sensor configured to detect an incoming threat and generate tracking data associated with the incoming threat;

an active protection system; and a controller coupled to the first sensor and active protection system and operable to receive the tracking data from the first sensor and determine a preferred countermeasure from a plurality of countermeasures with which to counter the incoming threat;

wherein the plurality of countermeasures includes the active protection system and a primary armament, wherein the controller is further operable to route the tracking data to a plurality of fire control processors, each of the plurality of fire control processors being associated with a respective one of the plurality of countermeasures; and wherein the plurality of fire control processors are operable to simultaneously compute a respective firing solution for each of the plurality of countermeasures using the tracking data.

15. The threat countering system of claim 8, further comprising: a second sensor coupled to the controller and configured to generate further tracking data associated with the incoming threat; wherein the controller is further operable to receive the further tracking data.

16. A threat countering system, the system comprising:

a controller including a processor and a memory; a passive sensor operable to detect muzzle flash indicative of a launch of an incoming threat;

a sensor system configured to generate tracking data associated with the incoming threat;

an active protection system; and software stored in the memory and executable by the processor to cause the controller to perform operations comprising:

receiving an indication from the passive sensor of an incoming threat;

activating the sensor system such that the sensor system generates tracking data associated with the incoming threat;

receiving tracking data from the sensor system;

determining a preferred countermeasure out of a plurality of countermeasures with which to counter the incoming threat, the plurality of countermeasures including the active protection system and a primary armament of a vehicle;

authorizing firing of the preferred countermeasure; and routing the tracking data from the sensor system to a plurality of fire control processors, each of the plurality of fire control processors being associated with a respective one of the plurality of countermeasures, and the plurality of fire control processors simultaneously computing a respective firing solution for each of the plurality of countermeasures using the tracking data.

17. The threat countering system of claim 16, wherein the determining a preferred countermeasure is based at least in part on the tracking data.

18. The threat countering system of claim 16, wherein the primary armament is a turret-based armament configured to fire explosive rounds containing shrapnel.

19. The threat countering system of claim 16, wherein the active protection system includes an interceptor launcher configured to launch explosive interceptors.

* * * * *